US007418891B2

(12) United States Patent
Choi

(10) Patent No.: US 7,418,891 B2
(45) Date of Patent: Sep. 2, 2008

(54) SPANNER

(75) Inventor: Ock-Soon Choi, Shindoo-Ri, 18-7, Yipjang-Myeon, Cheonan-Shi, Choongcheongnam-do, 330-826 (KR)

(73) Assignee: Ock-Soon Choi, Choongcheongnam-do (KR)

( * ) Notice: Subject to any disclaimer, the term of this patent is extended or adjusted under 35 U.S.C. 154(b) by 0 days.

(21) Appl. No.: 10/578,795

(22) PCT Filed: Nov. 6, 2004

(86) PCT No.: PCT/KR2004/002867

§ 371 (c)(1),
(2), (4) Date: May 18, 2007

(87) PCT Pub. No.: WO2005/044518

PCT Pub. Date: May 19, 2005

(65) Prior Publication Data

US 2007/0272059 A1 Nov. 29, 2007

(30) Foreign Application Priority Data

Nov. 7, 2003 (KR) ..... 20-2003-0034974 U
Apr. 14, 2004 (KR) ..... 20-2004-0010394 U

(51) Int. Cl.
*B25B 13/28* (2006.01)

(52) U.S. Cl. ..... 81/98; 81/111

(58) Field of Classification Search ..... 81/91.2, 81/92, 94, 98, 99, 111, 176.15
See application file for complete search history.

(56) References Cited

U.S. PATENT DOCUMENTS 2,430,349 A * 11/1947 Lefebvre ..... 30/164.95
2,514,687 A * 7/1950 Werner ..... 81/111
2,517,041 A * 8/1950 Sisley ..... 81/97
2,602,362 A * 7/1952 Johns ..... 81/92

(Continued)

FOREIGN PATENT DOCUMENTS

JP 7-186058 A 7/1995

(Continued)

*Primary Examiner*—David B Thomas
(74) *Attorney, Agent, or Firm*—MacPherson Kwok Chen & Heid LLP

(57) ABSTRACT

The present invention relates to a spanner having a toggle bar installed in at least a jaw and allowed to be rotated in one direction for tightening or releasing a bolt (or nut) continually by continuous operation of rotating the spanner's lever in one and other converse directions repeatedly in a state of gripping the bolt, which is also easily operative for tightening or releasing a bolt (or nut), especially when placed in a narrow gap. The spanner is constructed to comprise a lever; a jaw and a second jaw respectively extending from both sides of the lead end of the lever and forming a gripping space therebetween for gripping a bolt; a toggle bar installed on the lead end of the second jaw to be allowed to be rotated only to the outward of the gripping space; and a tension adjustment bolt installed in the long hole formed on the bottom of the second jaw and having a lead end connected to the inner side of the toggle bar so as to elastically support the toggle bar to the inward of the gripping space.

2 Claims, 5 Drawing Sheets

U.S. PATENT DOCUMENTS 2,618,996 A * 11/1952 Logan ..... 81/111
3,641,847 A * 2/1972 Horton ..... 81/111
3,921,474 A * 11/1975 Dyck et al. ..... 81/91.2
5,018,412 A * 5/1991 Wylie, III ..... 81/111
5,148,725 A 9/1992 Botha
5,896,790 A * 4/1999 Chiang ..... 81/98
5,927,159 A * 7/1999 Yokoyama et al. ..... 81/99
7,188,551 B2 * 3/2007 Choi ..... 81/98

FOREIGN PATENT DOCUMENTS

JP 10-249744 A 9/1998
JP 2000-263455 A 9/2000
JP 2000-334668 A 12/2000

* cited by examiner

SPANNER

TECHNICAL FIELD

The present invention relates to a spanner having a toggle bar installed on at least a jaw to be allowed to be rotated only in one direction for tightening or releasing a bolt (or nut) by continuous operation of pivoting the lever of the spanner in one and other converse directions repeatedly in a state of gripping the bolt.

BACKGROUND

Spanners are the most representative fastening tools for tightening or releasing a bolt or nut etc. operated by a leverage of the gripping lever in a shape of a stick. Generally, a spanner is constructed to have a gripping lever in a shape of a stick, and two jaws extending respectively from the lead end of the lever. When a bolt (or nut) is inserted in a gripping space formed between the two jaws, the bolt is tightened or released by rotating the lever while applying force to the lead end of the lever using the leverage exerted in proportion to the length of the lever.

At present, there are different kinds of spanners, such as a typical type of spanner having a fixed distal end between two jaws to be applicable to a bolt (or nut) of only one specification, a monkey spanner having a movable distal end between two jaws by relatively moving a jaw toward the other jaw to be applicable to a bolt of all specifications, and a ratchet spanner having a ratchet mechanism constructed to apply force only in one direction so as to be capable of tightening or releasing a bolt rapidly by the continuous operation of rotating the lever in one and other converse directions repeatedly in a state of gripping the bolt. Users selectively use the proper type of spanner depending on working conditions, but the ratchet spanner is most widely used for its convenience among these spanners.

However, if only a narrow gap is allowed for the operation of tightening a bolt where the ratchet spanner is not applicable due to the heavy thickness of its socket in spite of its convenience, then a user has to use a flat spanner. But, in a flat spanner, the user has to endure the inconvenience of repeatedly inserting the bolt in the jaws of the spanner after rotating the spanner a certain number of degrees, which has the problem of greatly decreasing efficiency.

To solve this problem, there has been suggested a spanner with a ratchet mechanism having a thin thickness and that can be operated without a socket, as disclosed in Korean Patent Laid-Open Publication Nos. 10-2000-0000449, 10-1999-0028347, and Korean Utility Model Registration Nos. 20-0243241 and 20-0261440.

However, these conventional spanners have a common problem in that their manufacturing is difficult due to the complex construction and structure of the ratchet mechanism installed for rotating in one direction. Moreover, the jaws for gripping the bolt have an overly large volume, therefore the spanner with a ratchet mechanism can't be used if only a narrow gap is allowed for the operation of tightening a bolt.

Considering these problems of conventional spanners with ratchet mechanisms, the applicant of the subject invention has also developed a spanner having a thin thickness as well as a simple construction and structure known as "an automatic spanner", as disclosed in Korean Utility Model Registration No. 20-0309103.

This automatic spanner solves the above problem partly, but it has a problem in that the toggle bar extrudes beyond the outside surface of the jaw so that the width (the distance between the outside surfaces of the two jaws) becomes too large, therefore the automatic spanner can't be used when a narrow gap in width is allowed for the operation of tightening the bolt. Moreover, it is difficult to adjust the tension of the torsion spring supporting the toggle bar, so that the friction force of the toggle bar against the bolt can't be adjusted appropriately to working conditions, which frequently decreases working efficiency. Also, the automatic spanner has another problem in that the rear end of the toggle bar extrudes to the exterior so that it is easily broken by external impact, and the torsion spring supporting the toggle bar is exposed to the exterior, so that the tension spring may easily rust or break from external impact, thus shortening the durability of the spanner.

DISCLOSURE

Technical Problem

Therefore, the present invention has been made in view of the above problems, and it is an object of the present invention to provide a spanner constructed to have a toggle bar extending not beyond the outer surface of the jaw so as to be capable of operating in a narrow working space, and a tension spring installed on the interior of the jaw for supporting the toggle bar so that it is less likely for the tension spring to rust or break from external impact and it is capable to easily adjust the tension of the spring. Furthermore, the friction force of the toggle bar is also easily adjustable properly according to working conditions.

Technical Solution

In accordance with an aspect of the present invention, the above and other objects can be accomplished by a spanner, comprising:

a lever;

a first jaw and a second jaw extending respectively from both sides of the lead end of the lever and forming a gripping space there between for gripping a bolt head or a nut;

a toggle bar connected on the lead end of the second jaw and allowed to pivot only toward the outward of the gripping space; and a tension spring installed in a long hole formed on the bottom of the second jaw and having a lead end connected to an inner side of the toggle bar so as to elastically support the toggle bar toward the inner side of the gripping space.

A spanner according to the present invention may further comprise a tension adjustment means including a tension adjustment bolt inserted in the long hole of the second jaw from the outer surface of the second jaw and engaged with the second jaw to be adjustably movable in an axial direction, and having a lead end connected to the tension spring for elastically supporting the tension spring so as to adjust the tension of the tension spring by adjusting the axial position of the tension adjustment bolt in the long hole.

Also, the tension adjustment means can be constructed to include a tension adjustment bolt inserted in the long hole of the second jaw and in the outer surface of the second jaw and engaged with the second jaw to be adjustably movable in axial direction, and having a lead end connected to the rear end of the tension spring; and a tension adjustment nut threadly engaged with the tension adjustment bolt in a state of the axial movement with regard to the second jaw being limited.

A spanner according to the present invention may selectively comprise a separation preventing protrusion protruding from the lead end of the first jaw diagonally toward the second jaw, or an elastic support plate made of elastic material connected to the first jaw and having a lead end extruding from the lead end of the first jaw diagonally toward the second jaw so as to elastically support a bolt head or nut gripped in the gripping space. The elastic support plate may comprise a convex guidance part formed on the lead end thereof and extruding convexly toward the second jaw.

Advantageous Effect

A spanner of the present invention as described above has the following advantages. The construction of the first and the second jaws does not cause the first and the second jaws to have a large thickness or width, so that a bolt (or nut) placed in a narrow gap can easily be tightened or released. Moreover, since the tension spring is installed on the interior of the jaw, the tension spring rarely rusts or breaks from external impact and in addition, the tension spring keeps rust-preventing lubrication oil within the long hole for a long period, which increases the durability of the spanner. The guiding operation of the convex guidance part of the elastic support plate enables a bolt to be easily gripped when gripping a bolt. Also, the elastic support plate elastically compresses the gripped bolt so that the spanner is not easily separated from the bolt when rotating the lever, which improves the working efficiency for tightening and releasing the bolt or nut.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of a spanner according to the present invention will be described in detail.

Figure 1:
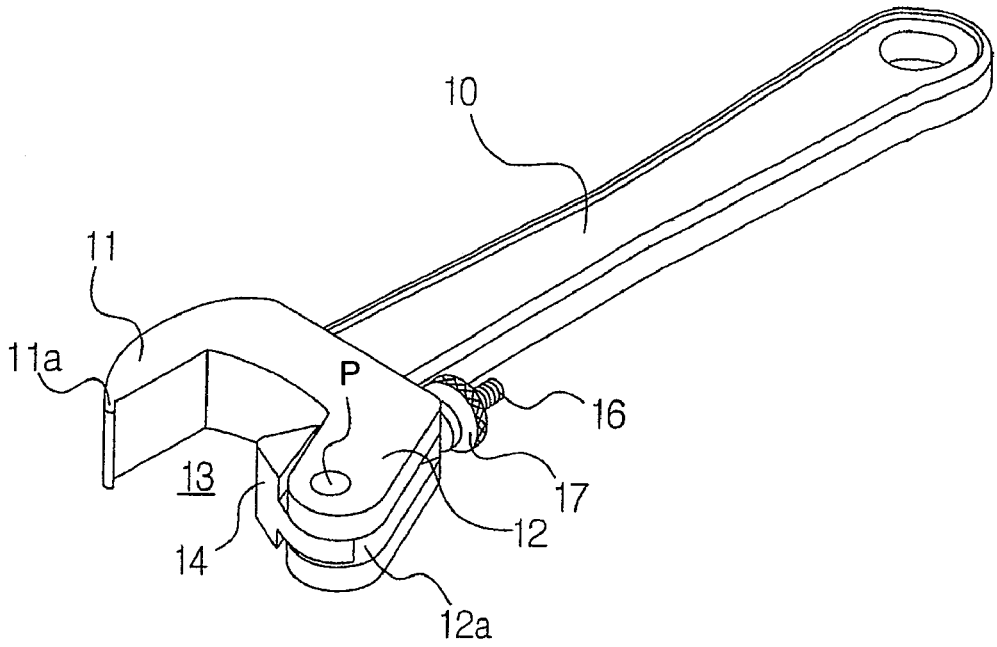
FIG. 1 is a perspective view of the spanner in accordance with the first embodiment of the present invention.
Figure 2:
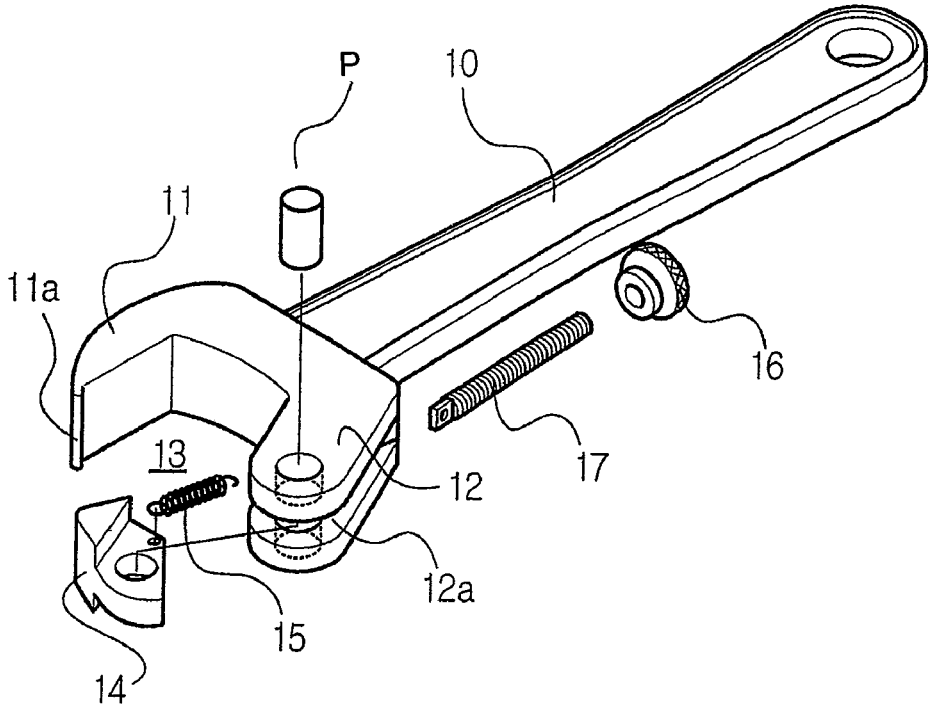
FIG. 2 is an exploded perspective view of the spanner in accordance with the first embodiment of the present invention.
Figure 3:
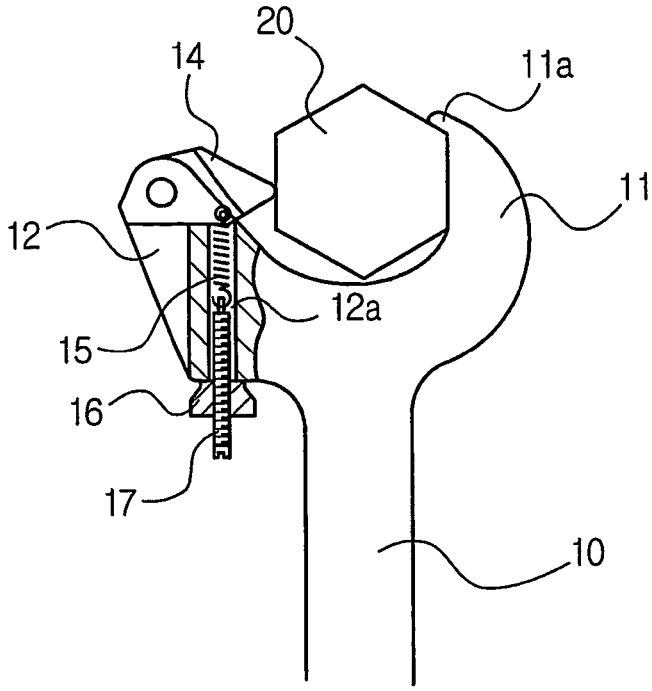
FIG. 3 is a cross-sectional view of the jaws of the spanner in accordance with the first embodiment of the present invention.

FIG. 1 is a perspective view of the spanner according to the first embodiment of the present invention, and FIGS. 2 and 3 are respectively an exploded perspective view and a cross-sectional view thereof.

As shown in the drawings, the spanner according to the present invention comprises a lever (10) in a shape of a stick as a handle; a first jaw and a second jaw (11,12) respectively extending from both sides of the lead end of the lever and forming a gripping space (13) therebetween for gripping a bolt (20); a toggle bar (14) installed on the lead end of the second jaw so as to be allowed to be rotated only toward the outward of the gripping space; a tension adjustment bolt (16) engaged with the long hole (12*b*) longitudinally formed on the bottom of the second jaw from the outer surface of the second jaw; a tension adjustment nut (17) for supporting the tension adjustment bolt (16) from the outside of the second jaw (12); and a tension spring (15) for connecting the middle part of the inner side of the toggle bar (14) to the lead end of the tension adjustment bolt (16) so as to elastically support the toggle bar (14).

In the above construction, the toggle bar (14) is inserted in a recess (12*a*) formed through the center part of the inner surface of the second jaw and the center part of the outer surfaces of the second jaw, and the rear end of the toggle bar (14) is rotatably hinged on the lead end of the second jaw (12) by a pin (P). The inner side of the toggle bar (14) is supported by the bottom surface of the recess (12*a*) so as to pivot only toward the outward of the gripping space (13), and toward the elastically supported inward of the gripping space (13) by the tension spring (15) connected to the middle part of the inner side of the toggle bar (14).

The tension adjustment bolt (16) is inserted in the long hole (12*b*) formed longitudinally through the bottom side of the second jaw (12) and connected to the rear end of the second jaw (12), and the axial movement of the tension adjustment bolt (16) with regards to the second jaw (12) is adjustably limited by the tension adjustment nut (17) positioned in close contact with the outer surface of the second jaw (12). Thus, the tension of the tension spring (15) is adjustable with respect to the axial position of the tension adjustment bolt (16) by means of the tension adjustment nut (17).

Figure 4:
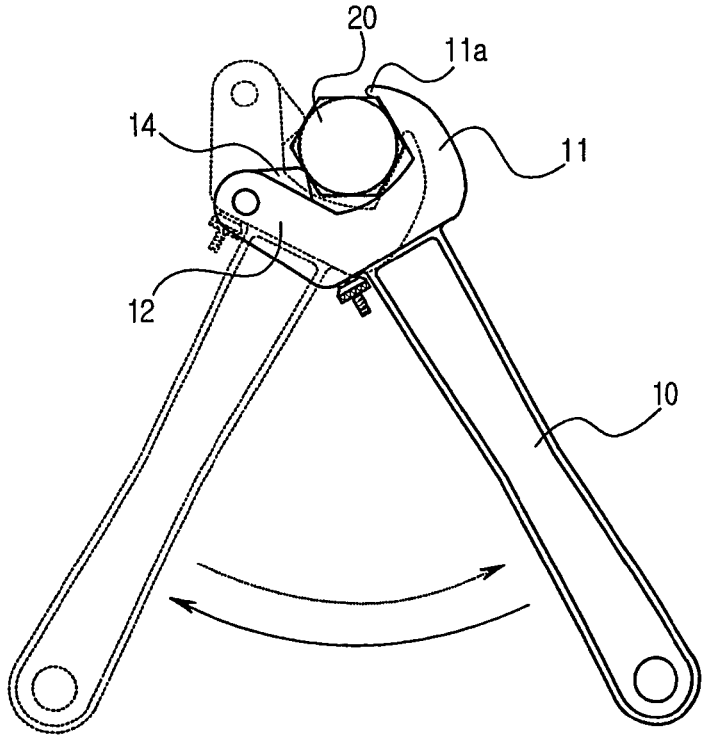
FIG. 4 is a diagram illustrating the operation of the spanner in accordance with the first embodiment of the present invention.

According to the first embodiment of the present invention as constructed above, the spanner tightens or releases the bolt (20) by using or acting upon the moment applied to the lever (10) of the spanner to the bolt (20) (or nut) inserted in the gripping space (13). That is, as shown in the FIG. 4, when the lever (10) is rotated repeatedly in one direction (from the direction of the first jaw to the direction of the second jaw) or in another converse direction (from the direction of the second jaw to the direction of the first jaw) in a state of gripping the bolt (20) in the gripping space (13) of the spanner according to the first embodiment of the present invention, the moment is applied to the lever (10) while one directional rotation from the first jaw (11) to the second jaw (12) is transmitted to both sides of the bolt via the lead end of the toggle bar (14) and the inner surface of the first jaw (11) so that the bolt becomes tightened or released (at this time, the rotation of the toggle bar (14) is supported and limited by the bottom surface of the recess (12*a*) of the second jaw). However, during the converse directional rotation from the second jaw (12) to the first jaw (11) (described as a broken line in FIG. 4), the toggle bar (14) is allowed to pivot to the outward of the second jaw (12) in a state of being elastically supported by the tension spring (15) which makes idling rotations in a state of gripping the bolt (20) in the gripping space (13) so that the spanner is easily returned to its initial position.

Thus, the spanner according to the first embodiment of the present invention is able to tighten or release the bolt in one direction by rotating the lever (10) in one direction and other converse directions repeatedly within a certain number of degrees of an angle in a state of gripping the bolt in the gripping space (13) because only the moment applied to the lever (10) during one directional rotation is transmitted to the bolt. Contrary to this, if the positions of the first jaw (11) and the second jaw (12) are replaced by each other, only the moment applied to the lever (10) during a converse directional rotation is transmitted to the bolt so that the bolt is tightened or released in a converse direction.

Figure 5:
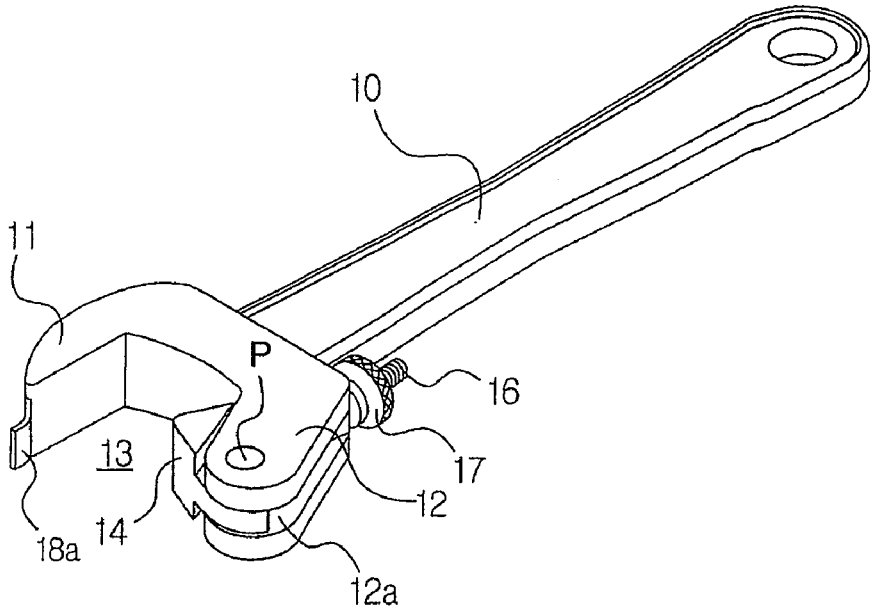
FIG. 5 is a perspective view of the spanner in accordance with the second embodiment of the present invention.
Figure 6:
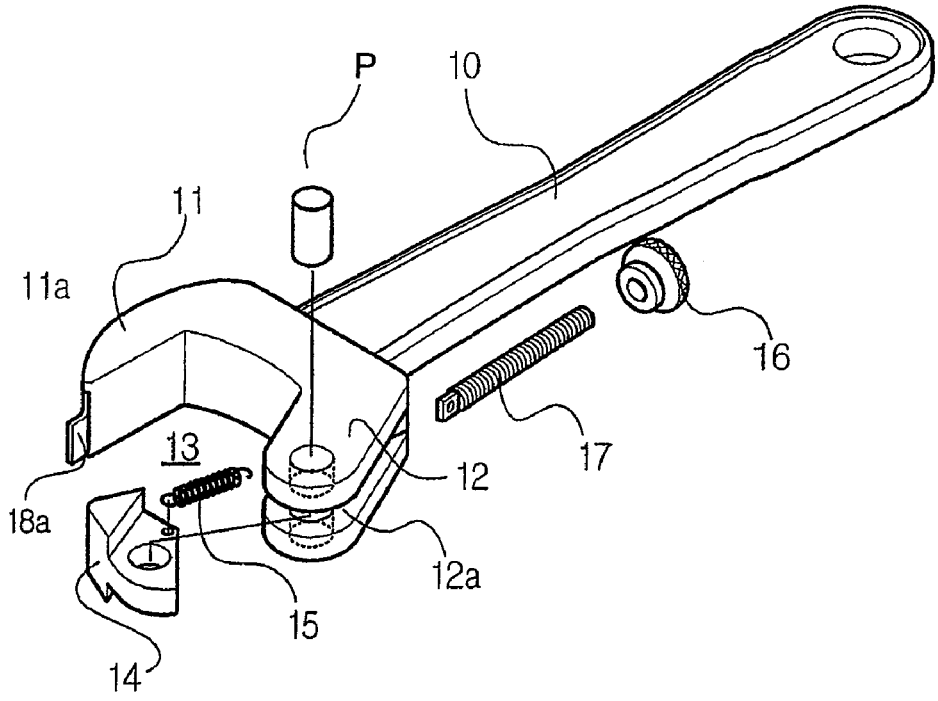
FIG. 6 is an exploded perspective view of the spanner in accordance with the second embodiment of the present invention.
Figure 7:
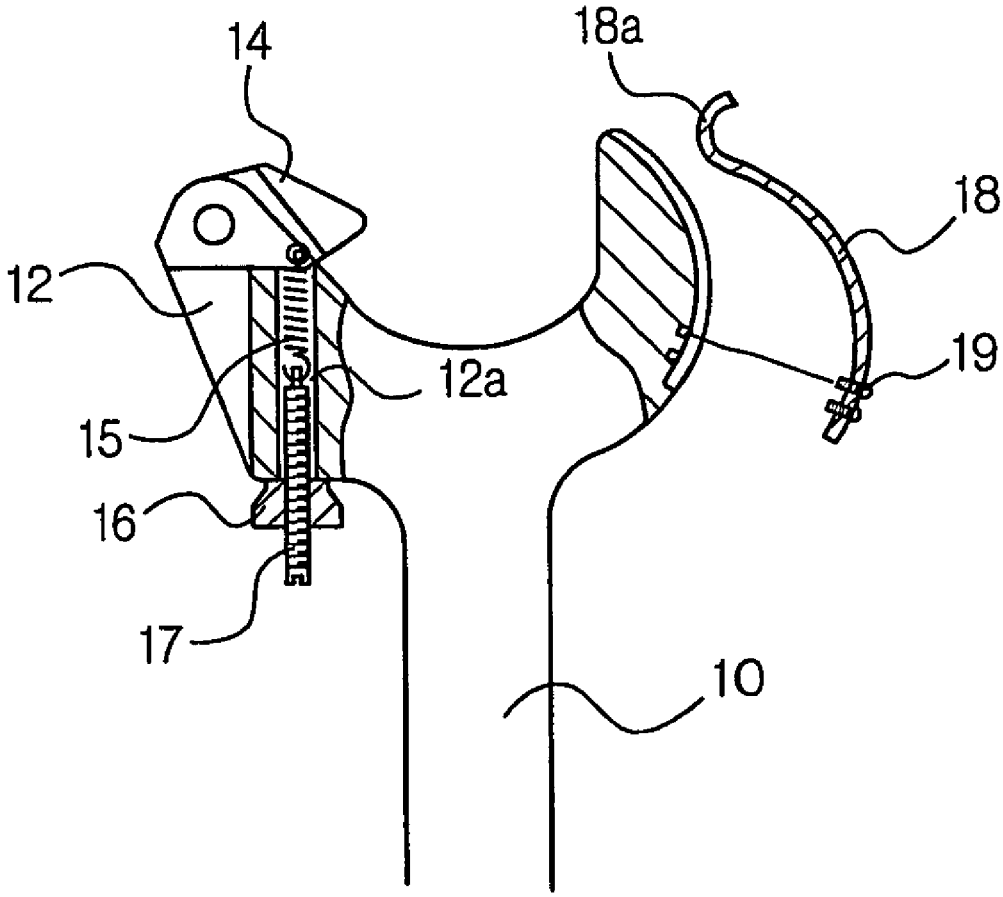
FIG. 7 is a cross-sectional view of the jaws of the spanner in accordance with the second embodiment of the present invention.

FIG. 5 is a perspective view of the spanner according to a second embodiment of the present invention, and FIGS. 6 and 7 are respectively an exploded perspective view and an cross-sectional view thereof.

As described in the drawings, the spanner according to the second embodiment of the present invention comprises: a lever (10); a first jaw and a second jaw (11, 12) extending from the lead end of the lever (10) to form a gripping space (13) therebetween; a toggle bar (14) rotatably hinged on the lead end of the second jaw so as to be allowed to be rotated only to the outward of the gripping space; a tension adjustment bolt (16) engaged with a long hole (12*b*) longitudinally formed on the second jaw (12) from the outer surface of the second jaw (12), and a tension adjustment nut (17) connected to the rear end of the tension adjustment bolt (16) from the outside of the second jaw (12); a tension spring (15) connected to the lead end of the tension adjustment bolt (16) for elastically supporting the toggle bar (14); and an elastic support plate (18) connected to the outer surface of the first jaw (11).

In the above construction, the spanner according to the second embodiment of the present invention is different from the first embodiment, as understood by comparing FIG. 3 with FIG. 7, wherein FIG. 7 further comprises an elastic support plate (18) provided on the outer surface of the first jaw (11).

The elastic support plate (18) has a lead end (11) extruded diagonally from the lead end of the first jaw (11) toward the gripping space (13) and a rear end connected to the outer surface of the first jaw (11) by a thread so as for the plate (18) to be elastically movable in the outward direction. The elastic support plate (18) has a curved portion on the lead end to be bent to the outward of the gripping space (13) to form a convex guidance part (18*a*).

Figure 8:
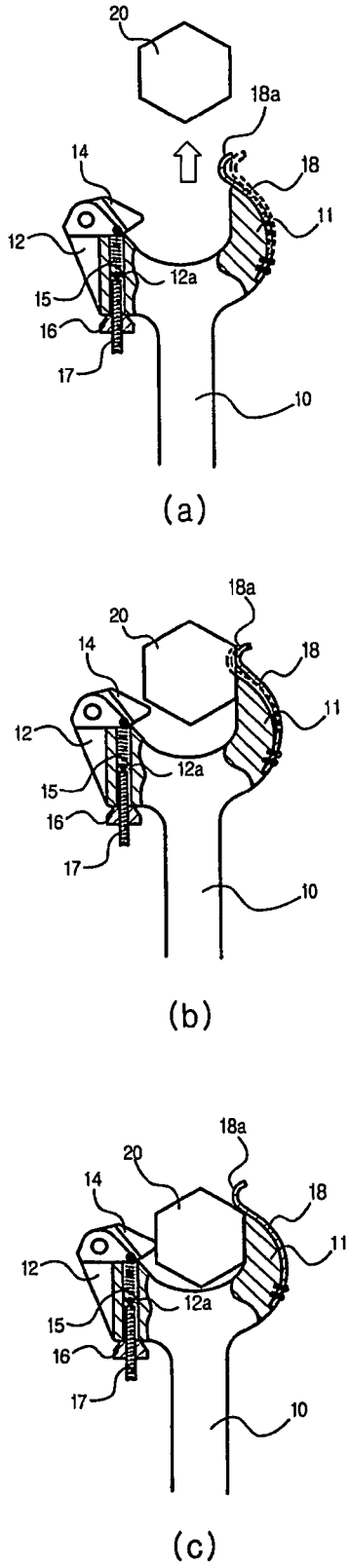
FIG. 8 is a diagram illustrating the operation of the elastic support plate of the spanner in accordance with the second embodiment of the present invention.

As shown in FIG. 8(*a*), when gripping the bolt between the first and the second jaw (11,12) for operation, the elastic support plate (118) acts to guide the bolt (20) into the gripping space (13) with the aid of the said convex guidance part (18*a*) so as to be easily engaged. As shown in FIGS. 8(*b*) and 8(*c*), the elastic support plate (18) is elastically displaced to the outward direction when the bolt (20) is gripped, and the elastic support plate (18) is then returned to the original position and elastically compresses the side surface of the bolt (20) so as to further prevent both jaws (11,12) from being separated from the bolt.

According to the above construction, the spanner of the second embodiment is able to tighten or release a bolt rapidly in one direction by rotating the lever (10) repeatedly in one and other converse directions within a certain number of degrees of an angle in a state of gripping the bolt in the gripping space (13) since only the moment applied to the lever (10) during one directional rotation is transmitted to the bolt. Contrary to this, if the positions of the first jaw (11) and the second jaw (12) are replaced by each other, only the moment applied to the lever (10) during a converse directional rotation is transmitted to the bolt, so that the bolt is tightened or released in a converse direction.

The spanner according to the second embodiment especially enables the bolt (20) to be easily inserted in the gripping space (13) when gripping the bolt (20) in the gripping space (13) of the spanner, since the convex guidance part (18*a*) of the elastic support plate (18) guides the bolt (20) to the gripping space (13). After gripping the bolt (20), the elastic support plate (18) elastically compress the bolt (20) so as not to separate the spanner from the bolt when rotating the lever (10) repeatedly in one and other converse directions, which makes the spanner able to more easily tighten or release the bolt (or nut) than the spanner of the first embodiment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the spanner according to the present invention enables the tightening or releasing of a bolt or nut by pivoting the lever repeatedly in a state of gripping the bolt or nut, and the thickness and the width of the first and the second jaws are not large so it becomes easy to tighten or release a bolt (or nut), especially a bolt (or nut) positioned in a narrow gap.

Moreover, the tension spring is installed on the interior of the jaw, so that the tension spring will rarely rust or break from external impact and in addition, the tension spring keeps rust-preventing lubrication oil within the long hole for a long period of time, so as to accordingly make the durability of the spanner long.

Also, the tension of the tension spring is adjustable so that the friction force of the toggle bar generated when the toggle bar rotates freely of the bolt is optimized to a proper amount, and the bolt is easily inserted in the gripping space since the convex guidance part of the elastic support plate guides the bolt to the gripping space when gripping the bolt in the gripping space of the spanner, and the elastic support plate elastically compresses the bolt so as not to have the spanner separated easily from the bolt when pivoting the lever, which greatly improves the working efficiency for the tightening and releasing of the bolt or nut.

The invention claimed is:

1. A spanner comprising:

a lever;

a first jaw and a second jaw respectively extending from both sides of a lead end of the lever and forming a gripping space therebetween for gripping a bolt;

a toggle bar installed on a lead end of the second jaw so as to be allowed to be rotated only to the outward of the gripping space;

a tension spring installed in a long hole formed longitudinally through the bottom side of the second jaw and having a lead end connected to the inner side of the toggle bar so as to elastically support the toggle bar to the inward of the gripping space;

a tension adjustment bolt engaged with the long hole from the outer surface of the second jaw to be adjustable movable in an axial direction;

a tension adjustment nut being threadly engaged with the tension adjustment bolt in a state of the axial movement being limited; and an elastic support plate made of elastic material connected to the first jaw and having a lead end extruding from the lead end of the first jaw diagonally toward the second jaw so as to elastically support a bolt head or nut gripped in the gripping space.

2. The spanner as set forth in claim 1, wherein the elastic support plate has a convex guidance part formed on the lead end and extruded toward the second jaw.

* * * * *